US005287982A

United States Patent [19]

Tsai

[11] Patent Number: 5,287,982

[45] Date of Patent: Feb. 22, 1994

[54] STRUCTURE FOR THE EXTERNAL CAP OF A SPOUT

[75] Inventor: John Tsai, Taipei, Taiwan

[73] Assignee: Ho Lee Co., Ltd., Taipei, Taiwan

[21] Appl. No.: 63,812

[22] Filed: May 20, 1993

[51] Int. Cl.[5] ..... B65D 41/00

[52] U.S. Cl. ..... 220/212.5; 215/305

[58] Field of Search ..... 220/212.5, 763, 764, 220/751; 215/305, 302, 303

[56] References Cited

U.S. PATENT DOCUMENTS

| | | | |
|---|---|---|---|
| 235,280 | 12/1880 | Norton | 220/212.5 |
| D. 286,147 | 10/1986 | Carlson | 220/751 X |
| 1,031,775 | 7/1912 | Cox | 215/303 |
| 1,289,947 | 12/1918 | Spengler | 215/303 X |

*Primary Examiner*—Allan N. Shoap

*Assistant Examiner*—Paul A. Schwarz

*Attorney, Agent, or Firm*—Lowe, Price, LeBlanc & Becker

[57] ABSTRACT

The improved structure for the external cap of a spout used in waterbeds has a cap body with a slot opening, and two flanges with punched holes extending from the edge of said external cap. The two supporting legs of a hand grip can feed through the punched holes of the flanges and move freely. The user can pull up the hand grip to rotate the external cap body in order to open or close said external cap. The horizontal portion of said hand grip has a T-shaped sectional surface which can be partially adapted into the slot; the bottom end portions of the supporting legs have inverted hooks on both sides to avoid the hand grip from disengaging with the external cap.

2 Claims, 5 Drawing Sheets

STRUCTURE FOR THE EXTERNAL CAP OF A SPOUT

BACKGROUND OF THE INVENTION (a) Field of the Invention

The present invention relates to the structure of the external cap of a spout assembly used in waterbed. More specifically, the present invention relates to an external cap with a hand grip which can be lifted up from a slot and rotated for opening or closing.

(b) Description of the Prior Art

Summer is hot and humid most of the time. People go to the beach, turn on the air conditioning or the fan and spray water on the floor to relieve from the summer heat. In recent years, waterbeds are getting popular. The waterbed can cool down the body temperature and provide relaxation during sleeping. The pressure at the spout of the waterbed is high. Therefore, the structure of the spout assembly is very important. Water will be everywhere in the room if the spout breaks or leaks. The Inventor, after many years of experience working in the waterbed industry, has found that the spouts are recessed below the surface of the waterbed. The high water pressure tends to press recessed open area towards the center of the spout. Although the external cap is not affected, the pressure expands the area from which the fingers can no longer get in to turn the external cap. The external cap was then modified to have two lugs on the edge, from which two semi-arc sections are attached. The semi-arc sections can be lifted up and pressed together for turning. But this kind of joining the semi-arc sections with the lugs is not sturdy, and the Inventor also found two disadvantages on the application:

1. Due to the frequent usages, the semi-arc sections tend to protruded upward above the waterbed surface. This causes some inconvenience since the design of the spout assembly shall be recessed below the surface of the waterbed.
2. If the semi-arc sections are not being used too often, then they tend to lean downward. This will make it difficult to lift them up for turning.

SUMMARY OF THE INVENTION

The main object according to the present invention is to provide an improved structure of the external cap for the spout of the waterbed such that it is easy for the user to open or close said external cap.

Another object according to the present invention is to provide an improved structure of the external cap with a hand grip which can be pulled up for turning or pushed down into a slot when not in use.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
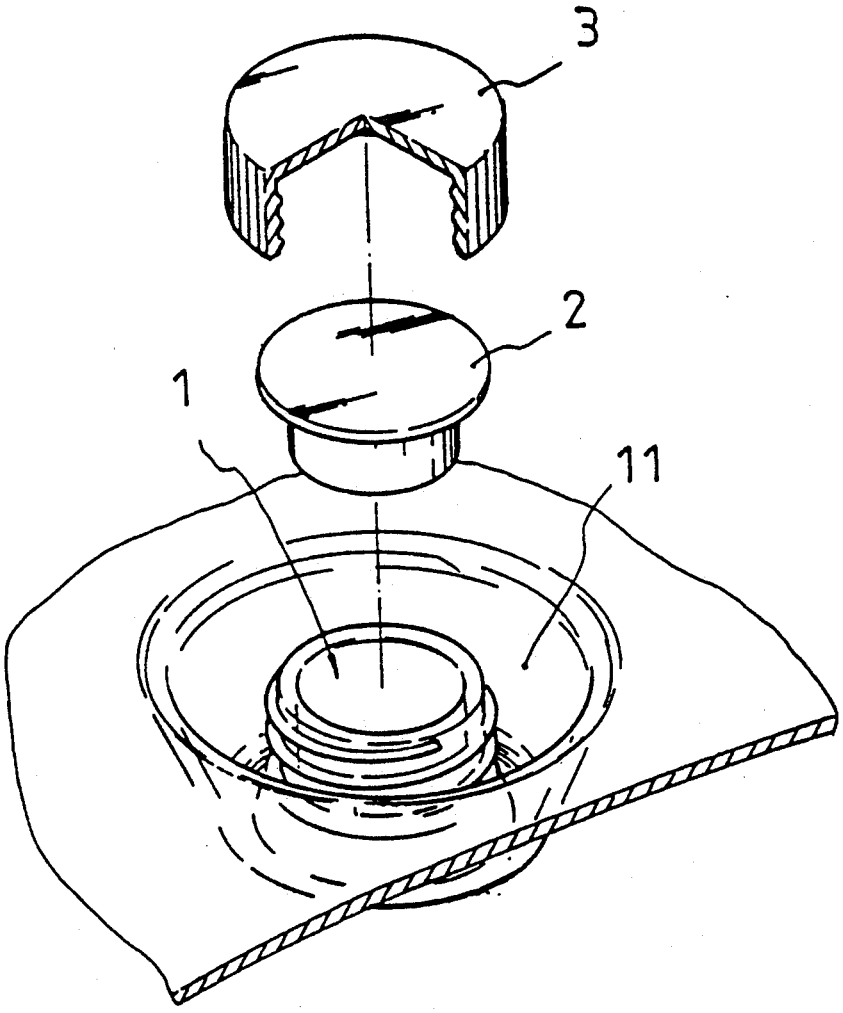
PRIOR ART FIG.1 A
FIG. 1A is a perspective view showing a prior art spout with its plug and external cap.
Figure 1B:
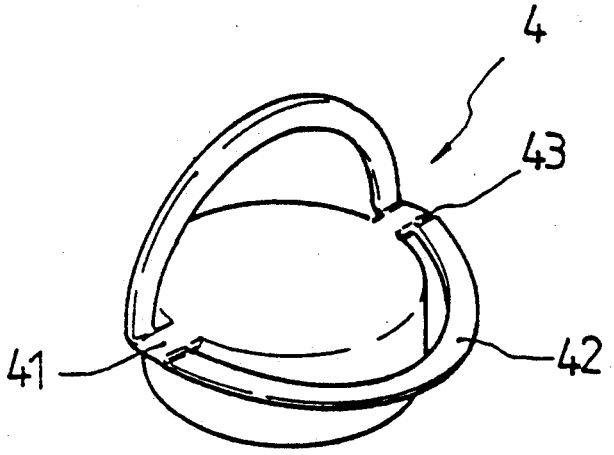
PRIOR ART FIG.1 B
FIG. 1B is a perspective view of another type of prior art spout.

A spout 1, a plug 2 and an external cap 3 is assembled in a waterbed such that the completed assembly does not protruded from the surface of the waterbed, as shown in FIG. 1A. The plug 2 is used to seal the water from leaking. The external cap 3 is screwed into the spout 1 to cap the plug 2 from falling off due to the water pressure. The drawback of the spout assembly as mentioned in the aforesaid paragraph is in a recessed area 11 surrounding said spout. The internal water pressure of the waterbed tends to deform the recessed area 11 towards the center, making it difficult to remove the external cap 3. To correct this disadvantage, another type of conventional spout assembly is shown in FIG. 1B. The exterior surface of the external cap 4 has two lugs 41 which are used for joining two semi-arc sections 42. The semi-arc section 42 can be lifted up and pressed together for turning. The rotatable portion 43 will either be protruded up or slanted down, which cause the two drawbacks as mentioned previously. It is also apparent that the diameter formed by the semi-arc section 42 is larger than the diameter of the external cap 4. Therefore, it is also difficult to remove the cap 4 due to the limited spacing available to lift and turn the semi-arc section 42.

Figure 2:
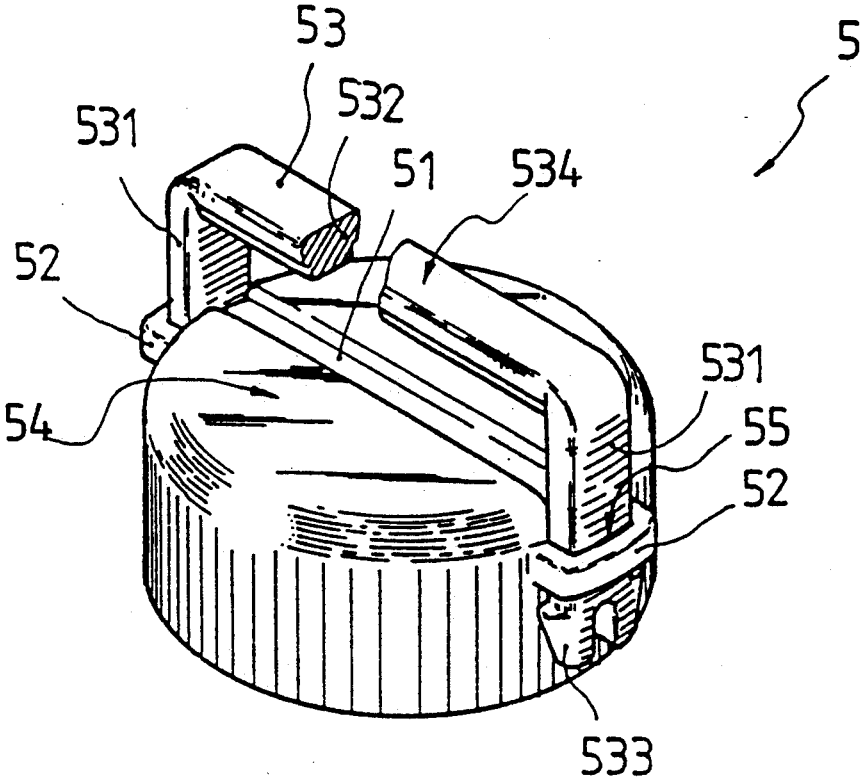
FIG. 2 is a perspective view of the external cap for the spout according to the present invention.
Figure 3:
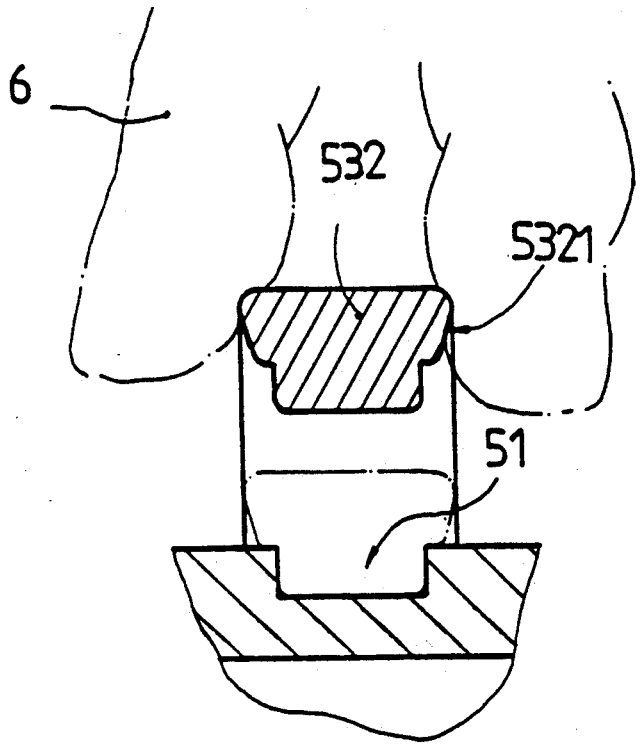
FIG. 3 is a cross-sectional view of the hand grip according to the present invention.

Please refer to FIG. 2 for a perspective view of the assembly according to the present invention. The external cap 5 according to the present invention mainly comprises an external cap 5 and a hand grip 53. The external cap 5 has a slot 51 at its top 54, and two flanges 52 are extended from the edge of the external cap 5; each flange 52 has a punched hole 55 which a supporting leg 531 of the hand grip 53 can feed through. The supporting legs 531 are free to move in the punched hole. The horizontal portion 534 of the hand grip 53 has a T shaped cross-sectional profile 532 which can be partially adapted into the slot 51, as shown in FIG. 3. The outer portion 531 which does not go into the slot 51 can be made such that it is convenient for fingers 6 to grab. The end of each supporting leg 531 has an inverted hook 533 to avoid the hand grip 53 from disengaging from the external cap 5.

Figure 4:
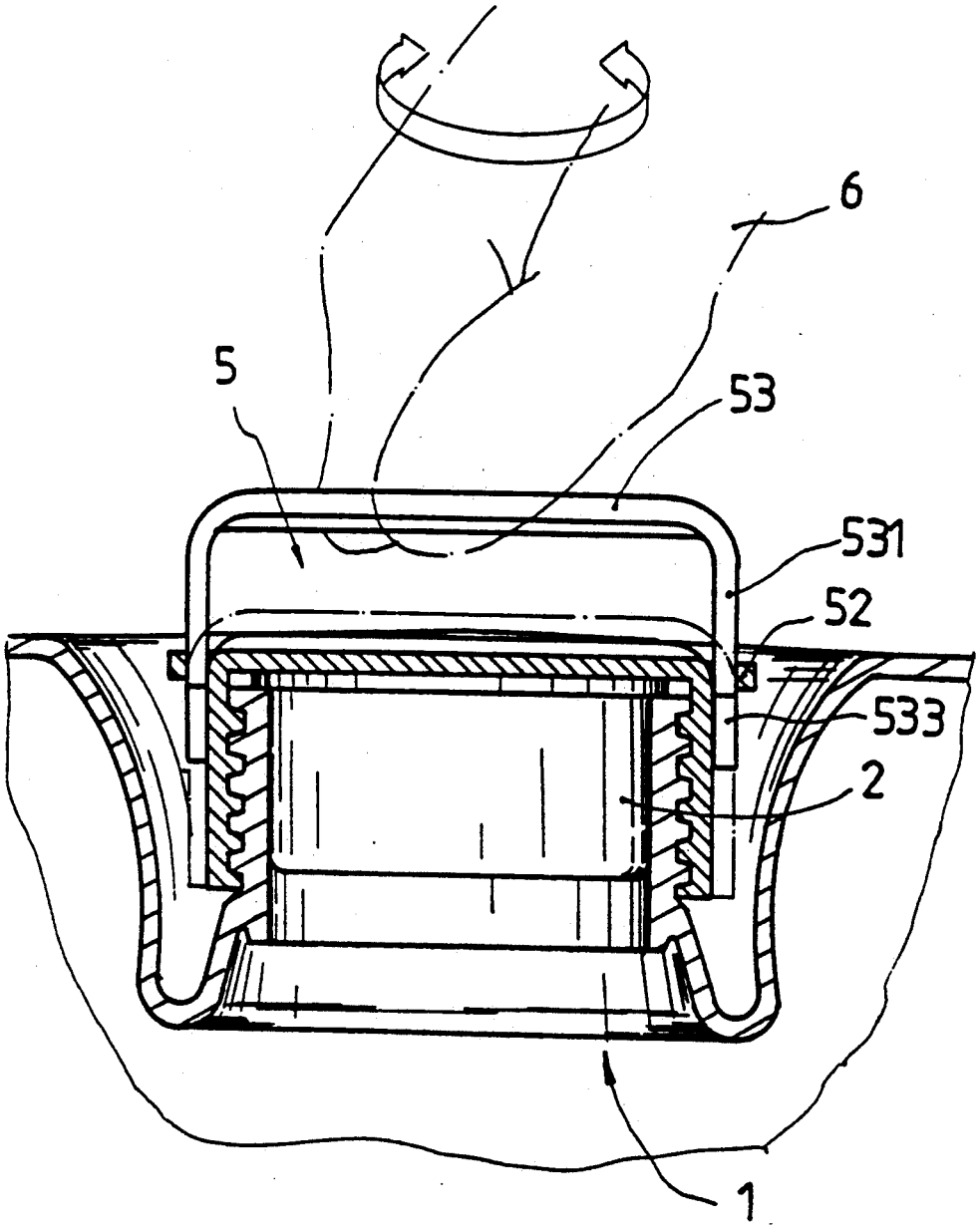
FIG. 4 is a cross-sectional view of the assembled spout, plug and external cap according to the present invention.

Using the above assembly, a user can gently grab the hand grip 53 and lift it up with his fingers 6. The inverted hooks 533 then engage with the flanges 52, the external cap 5 is now ready to be turned for opening or closing. To close the external cap after turning, the user needs to push the hand grip 53 down to its initial position, as shown in FIG. 4.

As compared to the conventional external caps 3 and 4, the external cap 5 according to the present invention has the following advantages:

1. The opening or closing of the external cap 5 according to the present invention is not affected by the deformation of the spout.
2. After the external cap 5 according to the present invention is closed and the hand grip 53 is pushed down, the completed water spout assembly of the waterbed is recessed below the surface of the waterbed.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. An improved structure for an external cap of a spout used in a waterbed comprising an external cap and a hand grip having a horizontal portion with opposing supporting legs, each of the supporting legs having a bottom end portion, the external cap having a slot at a top surface thereof, opposing flanges extending from a circumferential edge of the external cap, each of the flanges having a punched hole, said punched holes allowing the supporting legs of the hand grip to feed through the flanges to allow the supporting legs to move freely with respect to the punched holes, the bottom end portion of each of the supporting legs having an inverted hook to prevent the supporting legs from disengaging from the flanges, the horizontal portion of said hand grip having a T-shaped cross-sectional profile a portion of which can be fitted into the slot.

2. The external cap as recited in claim 1 wherein an outer portion of the horizontal portion of the hand grip does not enter the slot making the hand grip convenient for a user's finger to grab.

* * * * *